US006042209A

United States Patent [19]

Hawkins et al.

[11] Patent Number: 6,042,209

[45] Date of Patent: Mar. 28, 2000

[54] MICROFLUIDIC PRINTING WITH OPTICAL DENSITY CONTROL

[75] Inventors: Gilbert A. Hawkins, Mendon; Werner Fassler, Rochester; Charles D. DeBoer, Palmyra; James E. Pickering, Holcomb, all of N.Y.

[73] Assignee: Eastman Kodak Company, Rochester, N.Y.

[21] Appl. No.: 08/901,181

[22] Filed: Jul. 28, 1997

[51] Int. Cl.[7] ..... B41J 29/38

[52] U.S. Cl. ..... 347/6; 347/15; 347/43

[58] Field of Search ..... 346/140.1; 347/6, 347/3, 43, 15; 101/483, 115, 117, 153, 172, 2, 3

[56] References Cited

U.S. PATENT DOCUMENTS 5,771,810 6/1998 Wolcott ..... 347/6

*Primary Examiner*—John Barlow
*Assistant Examiner*—Juanita Stephens
*Attorney, Agent, or Firm*—Raymond L. Owens

[57] ABSTRACT

A microfluidic printing apparatus including at least one ink reservoir; a structure defining a plurality of chambers arranged so that the chambers form an array with each chamber being arranged to form an ink pixel; a plurality of microchannels connecting the reservoir to a chamber; a plurality of microfluidic pumps each being associated with a single microchannel for supplying ink from an ink reservoir through a microchannel for delivery to a particular chamber; and a structure for controlling the starting times of the microfluidic pumps and the time of separation of the receiver from the ink chambers so that the correct amount of ink is delivered from each chamber to each pixel on the receiver.

4 Claims, 5 Drawing Sheets

MICROFLUIDIC PRINTING WITH OPTICAL DENSITY CONTROL

CROSS REFERENCE TO RELATED APPLICATIONS

Reference is made to commonly assigned U.S. Pat. No. 5,679,139 "Cyan and magenta Pigment Set"; U.S. Pat. No. 5,679,141 entitled "Magenta Ink Jet Pigment Set"; U.S. Pat. No. 5,679,142 entitled "Cyan Ink Jet Pigment Set", all by McInerney, Oldfied, Bugner, Bermel, and Santilli; U.S. patent application Ser. No. 08/764,379 filed Dec. 13, 1996 entitled "Pigmented Inkjet Inks Containing Phosphated Ester Derivatives" by Martin; U.S. patent application Ser. No. 08/868,104 filed Jun. 3, 1997 entitled "Image Producing Apparatus For Microfluidic Printing" by Xin Wen; U.S. patent application Ser. No. 08/868,426 filed Jun. 3, 1997, entitled "Continuous Tone Microfluidic Printing" to DeBoer, Fassler and Wen, U.S. patent application Ser. No. 08/868, 416 filed Jun. 3, 1997 entitled "Microfluidic Printing on Receiver", to DeBoer, Fassler and Wen, No. U.S. patent application Ser. No. 08/688,102 filed Jun. 3, 1997 entitled "Microfluidic Printing with Ink Volume Control" to Wen, DeBoer and Fassler, U.S. patent application Ser. No. 08/868, 477 filed Jun. 3, 1997 entitled "Microfluidic Printing with Ink Flow Regulation" to Wen, Fassler and DeBoer, and U.S. patent application Ser. No. 08/901,654 filed concurrently herewith, entitled "Continuous Tone Microfluidic Printing" to Hawkins and Moghadam, all assigned to the assignee of the present invention. The disclosure of these related applications are incorporated herein by reference.

FIELD OF THE INVENTION

The present invention relates to microfluidic printing of colored ink pixels on a receiver.

BACKGROUND OF THE INVENTION

Microfluidic pumping and dispensing of liquid chemical reagents is the subject of three U.S. Pat. Nos. 5,585,069; 5,593,838; and 5,603,351, all assigned to the David Sarnoff Research Center, Inc. The system uses an array of micron sized reservoirs, with connecting microchannels and reaction cells etched into a substrate. Micro pumps include electrically activated electrodes within the capillary microchannels to provide the propulsive forces to move the liquid reagents within the system. The microkinetic pump, which is also known as an electroosmotic pump, has been disclosed by Dasgupta et al., see "Electroosmosis: A Reliable Fluid Propulsion System for Flow Injection Analysis", Anal. Chem. 66, pp. 1792–1798 (1994). The chemical reagent solutions are pumped from a reservoir, mixed in controlled amounts, and them pumped into a bottom array of reaction cells. The array may be decoupled from the assembly and removed for incubation or analysis. When used as a printing device, the chemical reagent solutions are replaced by dispersions of cyan, magenta, and yellow pigment, and the array of reaction cells may be considered a viewable display of picture elements, or pixels, comprising mixtures of pigments having the hue of the pixel in the original scene. When contacted with the receiver, the capillary force of the receiver fibers pulls the dye from the cells and holds it in the receiver, thus producing a hard copy print, or reproduction, of the original scene.

One problem with this kind of printer is the rendering of an accurate tone scale. The problem comes about because the capillary force of the paper fibers is strong enough to remove all the ink from the device, draining it empty. If, for example, a yellow pixel is being printed, the density of the image will be fully yellow. However, in some scenes, a light, or pale yellow is the original scene color. One way to solve this problem would be to stock and pump a number of yellow inks ranging from very light to dark yellow. Another way to solve the tone scale problem is to print a very small dot of dark yellow and leave white paper surrounding the dot. The human visual system will integrate the white and the small dot of dark yellow leading to an impression of light yellow, provided the dot is small enough. This is the principle upon which the art of color halftone lithographic printing rests. It is sometimes referred to as area modulation of tone scale. However, in order to provide a full tone scale of colors, a high resolution printer is required, with many more dots per inch than would be required if the colors could be modulated in optical density.

Another solution to the tone scale problem has been provided in the area of ink jet printers, as described in U.S. Pat. No. 5,606,351 by Gilbert A. Hawkins, the disclosure of which is hereby incorporated by reference. In an ink jet printer, the drop size is determined primarily by the surface tension of the ink and the size of the orifice from which the drop is ejected. The ink jet printer thus has a similar problem with rendition of tone scale. U.S. Pat. No. 5,606,351 overcomes the problem by premixing the colored ink with a colorless ink in the correct proportions to produce a drop of ink of the correct intensity to render tone scale. However, inkjet printers require a relatively high level of power to function, and they tend to be slow since only a few pixels are printed at a time (serial printing), in comparison to the microfluidic printer in which all the pixel are printed simultaneously (parallel printing).

SUMMARY OF THE INVENTION

An object of this invention to provide a compact, low powered printer which has a full tone scale of colors and prints a high quality continuous tone image.

A further object of this invention is to provide a rapid way to print high quality continuous tone ink images.

These objects are achieved by a method for continuous tone microfluidic printing color pixels on a receiver, comprising the steps of:

a) providing at least one ink reservoir;

b) providing a structure defining a plurality of chambers arranged so that the chambers form an array with each chamber being arranged to form an ink pixel;

c) a plurality of microchannels connecting the reservoir to a chamber;

d) a plurality of microfluidic pumps each being associated with a single microchannel for supplying ink from an ink reservoir through a microchannel for delivery to a particular chamber and;

e) control means for controlling the starting times of the microfluidic pumps and the time of separation of the receiver from the ink chambers so that the correct amount of ink is delivered to each chamber and to each pixel on the receiver.

The present invention provides high quality continuous tone prints.

Another feature of the invention is that the printer requires low power, and is compact and portable.

Yet another feature of the present invention is that by controlling the amount of ink delivered to a receiver, continuous tone pixels can be produced on such receiver.

It is an advantage in accordance with the present invention that the intensity of printed image pixels can be altered individually while simultaneously retaining the ability to precisely align image pixels to a predetermined array.

It is additionally advantageous that this method provides continuous tone color printing of image pixels having equal areas on the receiver regardless of the volumes of ink deposited.

A feature of this invention is to provide a method for making continuous tone image without the need for moving the printhead with respect to the receiver. A further object of this invention is to provide continuous tone color printing of image pixels which occupy equal areas on the receiver regardless of the volume of ink deposited in each one. Another feature of the present invention is to provide a method of grayscale printing that is insensitive to changes in ambient temperature experienced by the printer, the ink, and the receiver.

DETAILED DESCRIPTION OF THE INVENTION

The present invention is described in relation to a microfluidic printing apparatus which can print computer generated images, graphic images, line art, text images and the like, as well as continuous tone images.

Figure 1:
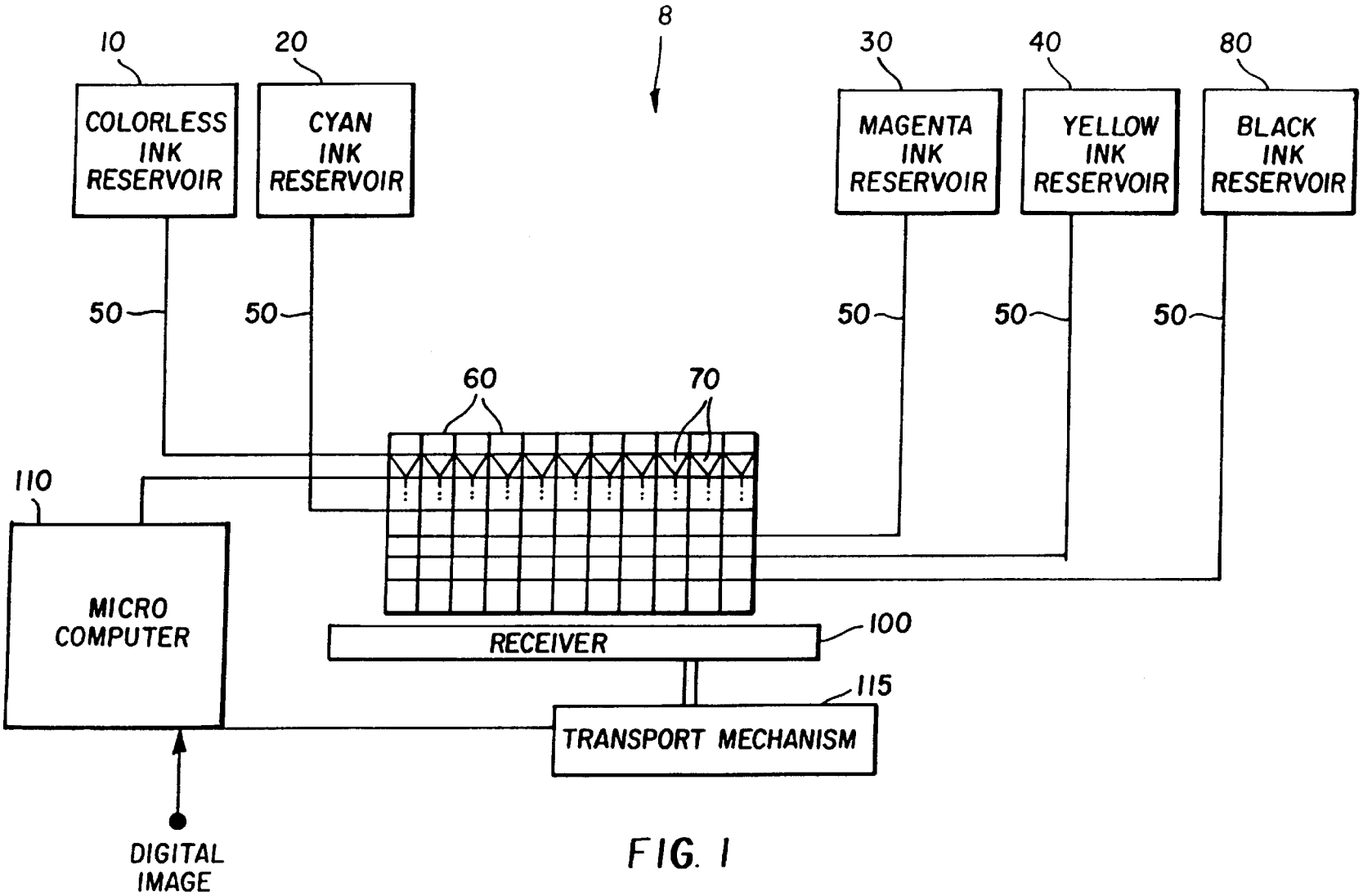
FIG. 1 is a partial schematic showing a microfluidic printing system for printing a digital image on a reflective receiver.

Referring to FIG. 1, a schematic diagram is shown of a printing apparatus 8 in accordance with the present invention. Reservoirs 20, 30, and 40 are respectively provided for holding cyan ink, magenta ink, and yellow ink. An optional reservoir 80 is shown for black ink. Microchannel capillaries 50 respectively connected to each of the reservoirs conduct ink from the corresponding reservoir to an array of ink chambers 60. In the present invention, the ink chambers 60 deliver the inks directly to a receiver; however, other types of ink delivery arrangements can be used such as microfluidic channels, and so when the word chamber is used, it will be understood to include those arrangements. The colored inks are delivered to ink chambers 60 by microfluidic pumps 70. The amount of each color ink is controlled by microcomputer 110 according to the input digital image. For clarity of illustration, only one set of microfluidic pumps is shown for the yellow ink channel. Similar pumps are used for the other color channels, but these are omitted from the figure for clarity. Finally, a reflective receiver 100 is transported by a transport mechanism 115 to come in contact with the microfluidic printing apparatus. The receiver 100 receives the ink and thereby produces the print. Receivers may include common bond paper, made from wood fibers, as well as synthetic papers made from polymeric fibers. In addition the receiver can be of non-fibrous construction, provided the receiver can absorb and hold the ink used in the printer.

Figure 2:
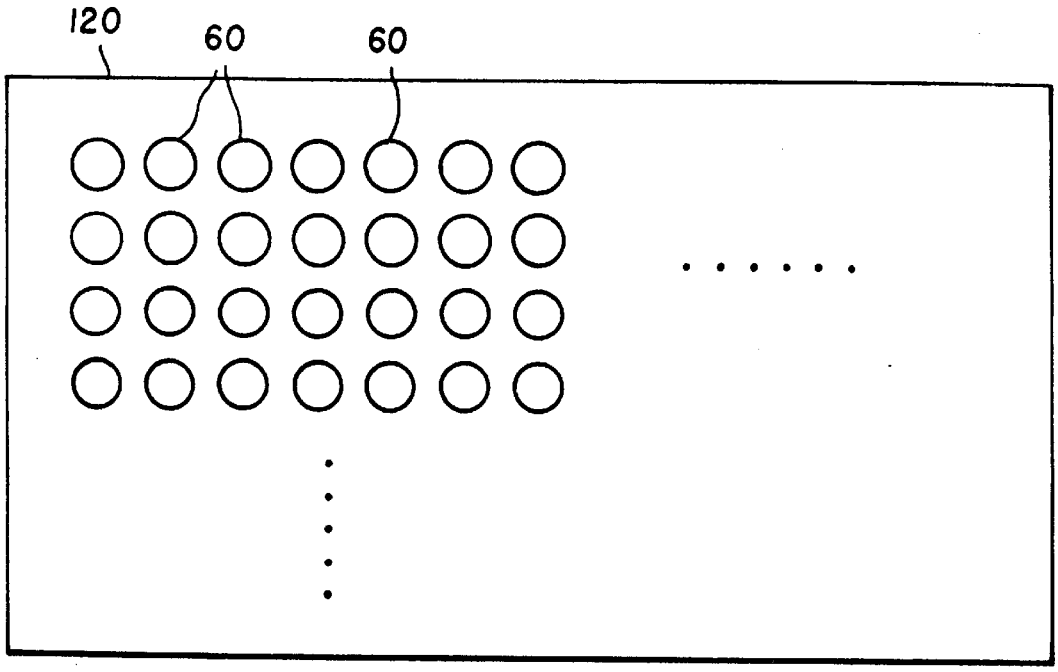
FIG. 2 is a top view of a pattern of the color pixels which can be produced by apparatus in accordance with the present invention.

FIG. 2 depicts a top view of an arrangement of chambers 60 shown in FIG. 1. Each ink chamber 60 is capable of producing a mixed ink having any color saturation and hue within the color gamut provided by the set of cyan, magenta and yellow inks used in the apparatus.

The inks used in this invention are dispersions of colorants in common solvents. Examples of such inks may be found is U.S. Pat. No. 5,611,847 by Gustina, Santilli and Bugner. Inks may also be found in the following commonly assigned U.S. Pat. Nos. 5,679,139; 5,679,141 and 5,679,142 by McInerney, Oldfield, Bugner, Bermel and Santilli, and in U.S. Pat. No. 5,698,018 Bishop, Simons and Brick, and in U.S. patent application Ser. 08/764,379 by Martin. In a preferred embodiment of the invention the solvent is water. Colorants such as the Ciba Geigy Unisperse Rubine 4BA-PA, Unisperse Yellow RT-PA, and Unisperse Blue GT-PA are also preferred embodiments of the invention.

The microchannel capillaries, ink pixel chambers 60 and microfluidic pumps are more fully described in the references listed above.

Figure 3:
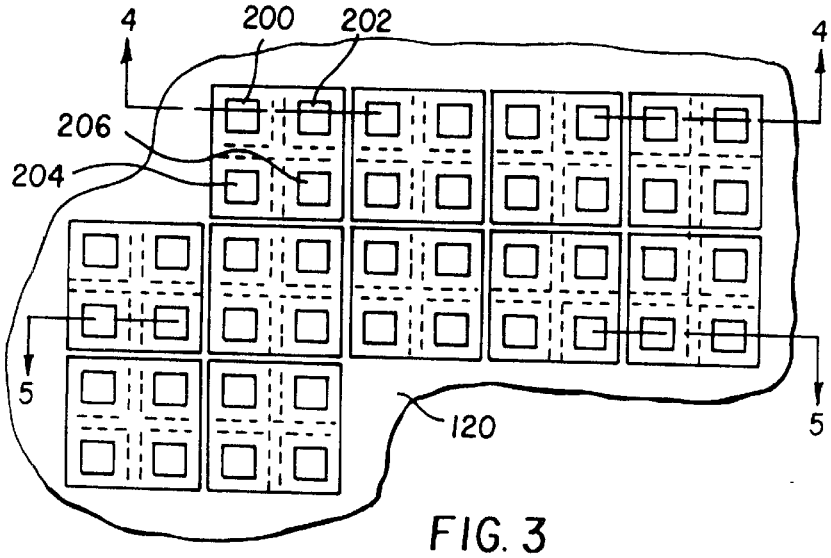
FIG. 3 is a top view of a second pattern of the color pixels which can be produced by apparatus in accordance with the present invention.

FIG. 3 illustrates the arrangement of a second pattern of color pixels in the present invention. The ink chambers 60 are divided into four groups cyan ink orifice 200; magenta ink orifice 202; yellow ink orifice 204; and black ink orifice 206. Each chamber 60 is connected only to the respective colored ink reservoir. When the inks are transferred to the reflective receiver 100 some of the inks can mix and blend on the receiver. Inasmuch as the inks are in distinct areas on the receiver, the size of the printed pixels should be selected to be small enough so that the human eye will integrate the color and the appearance of the image will be that of a continuous tone photographic quality image.

Figure 4:
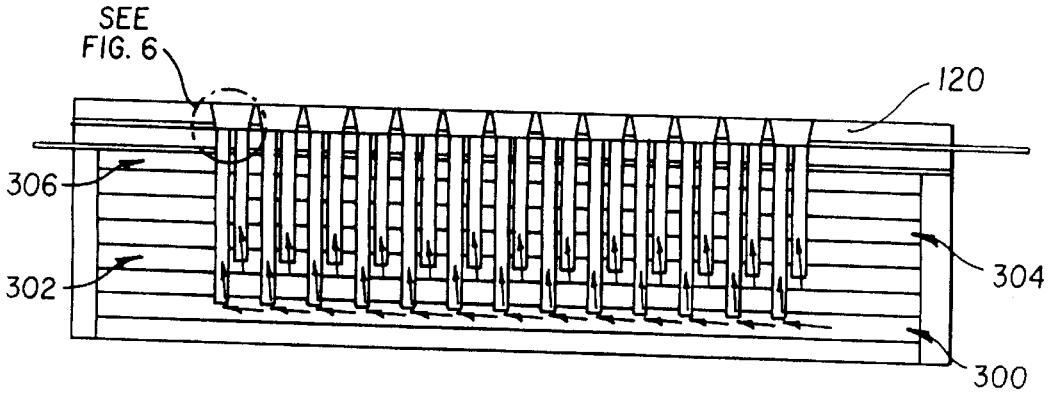
FIG. 4 is a cross-sectional view taken along the lines 4—4 of the microfluidic printing apparatus in FIG. 3.
Figure 5:
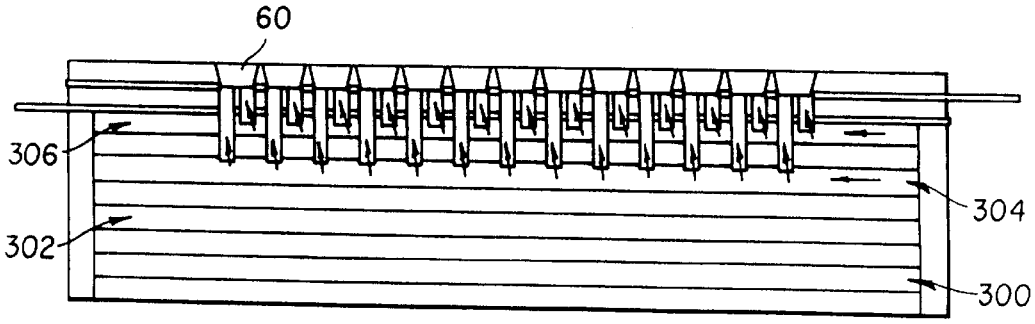
FIG. 5 is another cross-sectional taken along the lines 5—5 of the microfluidic printing apparatus in FIG. 3.

Cross-sections of the color pixel arrangement shown in FIG. 3 are illustrated in FIG. 4 and FIG. 5. The colored ink supplies 300, 302, 304, and 306 are fabricated in channels parallel to the printer front plate 120. The cyan, magenta, yellow and black inks are respectively delivered by colored ink supplies 300, 302, 304, and 306 into each of the colored ink chambers 60.

Figure 6:
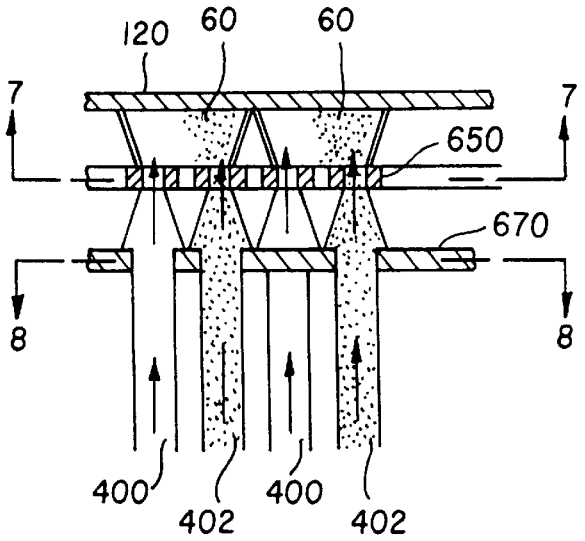
FIG. 6 is an enlarged view of the circled portion of FIG. 4.

A detailed view of the cross-section in FIG. 4 is illustrated in FIG. 6. The colored inks are delivered to the ink chambers 60 respectively by cyan, magenta, yellow, and black ink microchannels 400, 402, 404, and 406. (404 and 406 do not show up in the plan shown in FIG. 6, but is illustrated in FIG. 8) The colored ink microchannels 400, 402, 404, and 406 are respectively connected to the colored ink supplies 300, 302, 304, and 306 (FIGS. 4 and 5).

Figure 7:
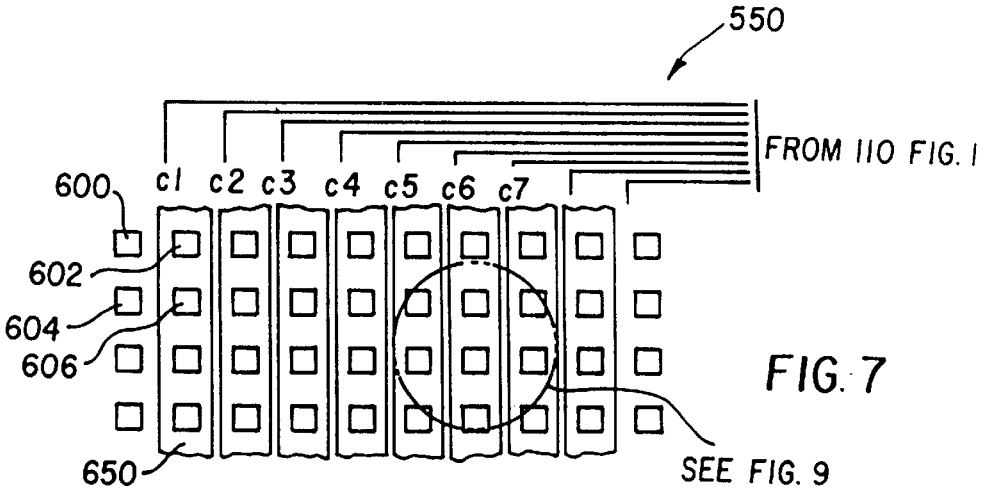
FIG. 7 is a top view of the micronozzles shown in FIG. 6.

A cross-section view of the plane containing the micronozzles in FIG. 6 is shown in FIG. 7. The cyan, magenta, yellow, and black ink micronozzles 600, 602, 604, and 606 are distributed in the same arrangement as the colored ink supply lines 300–304 and the termination of the chambers 60 which are colored ink orifices 200–206. The column electrodes 650 are shown connected to the conducting circuit 550, which is further connected to microcomputer 110.

Figure 8:
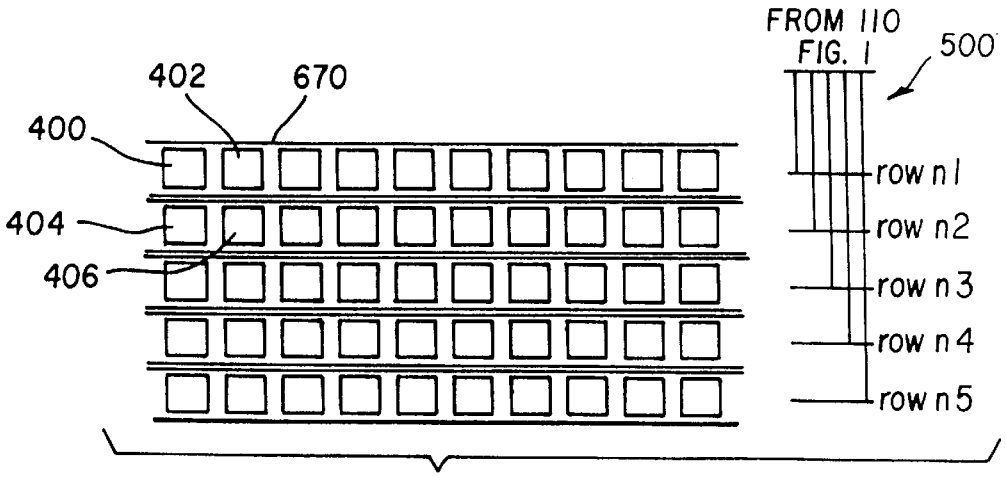
FIG. 8 is a top view of the microchannel and showing conducting circuit connections in FIG. 6.

A cross-section view of the plane containing the microchannels 400, 402,404, and 406 in FIG. 6 is shown in FIG. 8. The color ink channels 400–406 are laid out in the spatial arrangement that corresponds to those in FIGS. 3 and 7. The lower electrodes in the microfluidic pumps for delivering the colored inks are not shown for clarity of illustration. The row electrodes 670 are connected to lower electrodes of the microfluidic pumps. The row electrodes 670 are shown connected to the conducting circuit 500, which is further connected to microcomputer 110.

The operation of a microfluidic printer comprises the steps of activating the microfluidic pumps to pump the correct amount of each color ink to the chamber 60 to provide a pixel of the correct hue and intensity corresponding to the pixel of the scene being printed. The receiver may be placed in contact with the ink chambers 60 in the printer front plate 120 a) before activating the microfluidic pumps, b) while activating the microfluidic pumps, or c) after activating the microfluidic pumps, as will be seen in FIGS. 9–11 below. When placed in contact with the receiver, capillary forces draw the ink from the chambers 60 to the receiver. In order to provide the correct density of each pixel of the printed image, the operation of the microfluidic pumps is timed by signals from the computer. Where a dark colored, high density pixel is desired, the pump is started at or near the beginning of the printing sequence. Ink therefore flows from the chamber 60 to the receiver during all or most of the printing sequence time. Where a light colored, low density pixel is desired, the pump is turned on near the end of the printing sequence. Ink therefore flows from the chamber 60 to the receiver a short fraction of the printing sequence time and thus relatively little ink is delivered, so the pixel is of low optical density. The receiver is then removed from contact with the chambers 60 by an actuator controlled by a timed signal from the computer and permitted to dry. Timing of the removal of the receiver is critical to prevent excess ink to be drawn from the microchannels 400, 402, 404, and 406 that feed the chambers 60. As the following figures show, the receiver can be in contact with the printing plate 120 before the pumps are activated, while the pumps are activated, or after the pumps are activated.

Figure 9:
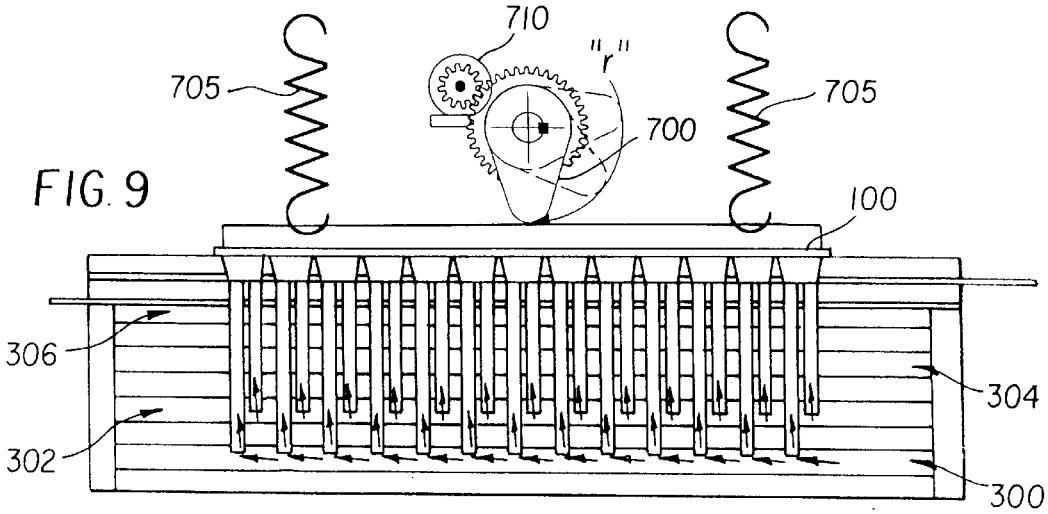
FIG. 9 is a diagram illustrating a printing sequence where the receiver is placed in contact with the ink chambers before activating the microfluidic pumps.

FIG. 9 illustrates the timing circuit of the invention for a printing sequence wherein 1) the receiver 100 is placed in contact with the ink chambers 60; and 2) then the microfluidic pumps are activated in a timed succession, first for the pixels with the highest optical density, secondly for the medium density pixels, thirdly for the lighter density pixels, and so forth for as many levels of optical density that are required for a high quality continuous tone print; and 3) the receiver is separated from the ink chambers by an actuator 700, consisting of a cam driven by a motor 710 through the radius "r". The force for separating the receiver from the printing plate is supplied by springs 705. All of the events in the printing sequence are precisely timed by electrical signals from the microcomputer 110.

The microcomputer 110 activates microfluidic pumps 70 after the receiver is moved to the ink transfer position and varying the starting times of actuation of different microfluidic pumps 70 to control the density of ink delivered to each pixel and then deactivates the microfluidic pumps 70 and further including a receiver separation actuator 700 for removing the receiver to the non-transfer position to separate the receiver from the ink chambers. A variety of actuators can be used to separate the receiver from the ink chambers, including magnetic solenoids or a simple motor driven cam system. It is important in choosing an actuator that the device be capable of accurate timing so the receiver remains in contact with the ink chambers for the precise amount of time required to reach an accurate density.

Figure 10:
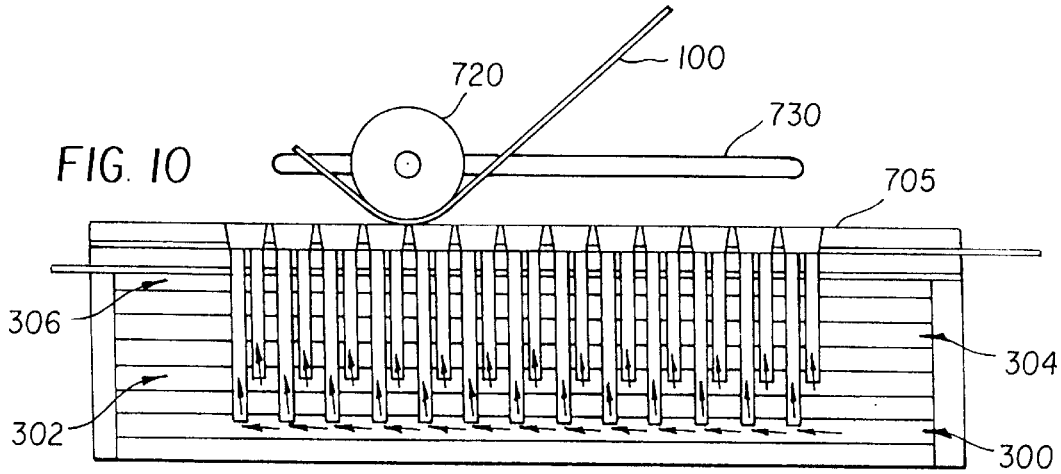
FIG. 10 is a diagram illustrating a printing sequence where the receiver is placed in contact with the ink chambers simultaneously with the activation of the microfluidic pumps.

FIG. 10 illustrates a printing sequence wherein 1) the receiver 100 is placed in contact with the printing plate 120 in a line by line fashion as the line contact roller 720 moves across the receiver along the roller guide 730, and 2) the microfluidic pumps are activated in a timed succession, corresponding both to the line being printed and to the optical density of each pixel in the line. The separation of the receiver from the ink chambers is controlled by the rate of motion of the line contact roller 720.

Figure 11:
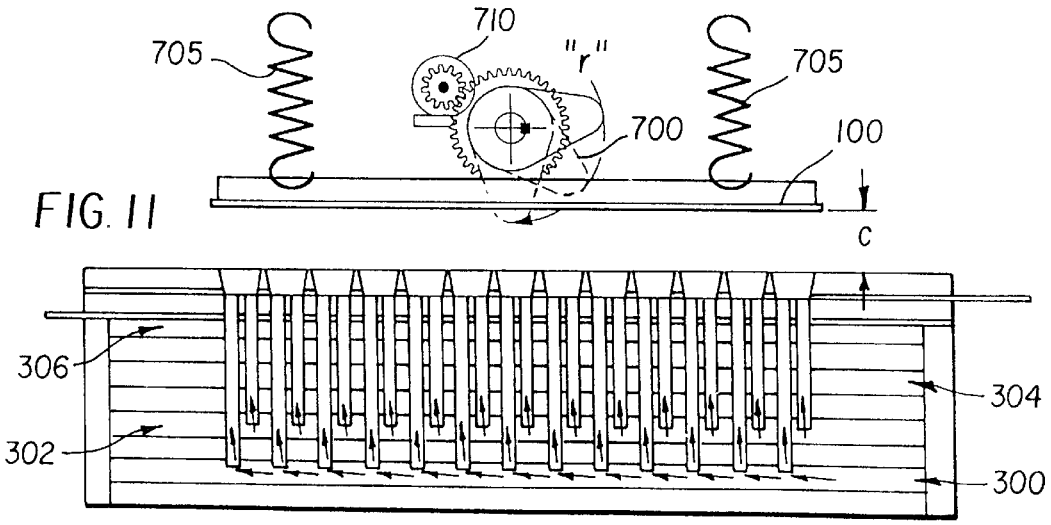
FIG. 11 is a diagram illustrating a printing sequence where the receiver is placed in contact with the ink chambers after completion of the activation of the microfluidic pumps.

FIG. 11 illustrates yet another printing sequence wherein 1) the microfluidic pumps are activated in a timed succession, first for the pixels with the highest optical density, secondly for the medium density pixels, thirdly for the lighter density pixels, and so on, for as many levels of optical density that are required for a high quality continuous tone print, and 2) after all the ink chambers are filled the receiver is placed in contact with the ink chambers by the action of the receiver separation actuator 700 driven by the motor 710 overcoming the force of the springs 705 to travel the distance "c" and contact the printing plate for the length of time required to absorb the correct amount of ink to accurately reproduce the optical density of the pixels of the image being printed after which the action of the receiver separation actuator 700 is continued to separate the receiver from the printing plate.

The invention has been described in detail with particular reference to certain preferred embodiments thereof, but it will be understood that variations and modifications can be effected within the spirit and scope of the invention.

PARTS LIST

| | |
|---|---|
| 8 | microfluidic printing system |
| 20 | cyan ink reservoir |
| 30 | magenta ink reservoir |
| 40 | yellow ink reservoir |
| 50 | microchannel capillaries |
| 60 | ink chambers, or printing nozzles |
| 70 | microfluidic pumps |
| 80 | black ink reservoir |
| 100 | receiver |
| 110 | microcomputer |
| 115 | transport mechanism |
| 120 | printer front plate |
| 200 | colored ink orifices |
| 202 | colored ink orifices |
| 204 | colored ink orifices |
| 206 | colored ink orifices |
| 300 | colored ink supply lines |
| 302 | colored ink supply lines |
| 304 | colored ink supply lines |
| 306 | black ink supply |
| 400 | cyan ink microchannel |
| 402 | magenta ink microchannel |
| 404 | yellow ink microchannel |
| 406 | black ink microchannel |
| 500 | conducting circuit |
| 550 | conducting circuit |
| 600 | cyan ink micro-orifice |
| 602 | magenta ink micro-orifice |
| 604 | yellow ink micro-orifice |
| 606 | black ink micro-orifice |

-continued

| PARTS LIST | |
|---|---|
| 650 | column electrodes |
| 670 | row electrodes |
| 700 | receiver separation actuator |
| 705 | spring |
| 710 | motor |
| 720 | line contact roller |
| 730 | roller guide |

What is claimed is:

1. A microfluidic printing apparatus for printing on a receiver comprising:

a) at least one ink reservoir;

b) a structure defining a plurality of chambers arranged so that the chambers form an array with each chamber being arranged to form an ink pixel on the receiver;

c) a plurality of microchannels connecting the reservoir to a chamber;

d) a plurality of microfluidic pumps each being associated with a single microchannel after being started for supplying ink from an ink reservoir through a microchannel for delivery to a particular chamber;

e) a transport mechanism for moving the receiver into and out of ink transfer relationship with the chambers; and f) control means for controlling the starting times of the microfluidic pumps so that ink from different chambers is transferred to the receiver for different durations so that a correct amount of ink is delivered from each chamber to each pixel on the receiver.

2. A microfluidic printing apparatus for printing on a receiver comprising:

a) at least one ink reservoir;

b) a structure defining a plurality of chambers arranged so that the chambers form an array with each chamber being arranged to form an ink pixel on the receiver;

c) a plurality of microchannels connecting the reservoir to a chamber;

d) a plurality of microfluidic pumps each being associated with a single microchannel after being started for supplying ink from an ink reservoir through a microchannel for delivery to a particular chamber;

e) means for successively moving portions of the receiver between ink transfer and non-transfer positions; and f) control means for varying the starting times of different microfluidic pumps and a time for the receiver moving means for moving a sheet from the ink transfer to non-ink transfer positions where the receiver is separated from the ink chambers so that a correct amount of ink is delivered from each chamber to each pixel on the receiver.

3. A microfluidic printing apparatus for printing on a receiver comprising:

a) at least one ink reservoir;

b) a structure defining a plurality of chambers arranged so that the chambers form an array with each chamber being arranged to form an ink pixel on the receiver;

c) a plurality of microchannels connecting the reservoir to a chamber;

d) a plurality of microfluidic pumps each being associated with a single microchannel after being started for supplying ink from an ink reservoir through a microchannel for delivery to a particular chamber;

e) means for successively moving portions of a receiver between ink transfer and non-transfer positions; and f) control means for activating the microfluidic pumps after the receiver is moved to the ink transfer position and varying the starting times of actuation of different microfluidic pumps to control a density of ink delivered to each pixel and then deactivating the microfluidic pumps and further including a receiver separation actuator for removing the receiver to the non-transfer position to separate the receiver from the ink chambers.

4. The apparatus of claim 3 wherein a line of pixels is printed sequentially and further including a line contact roller for contacting the receiver at the ink transfer position.

* * * * *